US008111173B2

(12) United States Patent
Schmitz

(10) Patent No.: US 8,111,173 B2
(45) Date of Patent: Feb. 7, 2012

(54) METHOD OF DETECTING AND DOCUMENTING TRAFFIC VIOLATIONS, SUCH AS RED LIGHT VIOLATIONS OR SPEEDING VIOLATIONS

(75) Inventor: Ralf Schmitz, Wiehl (DE)

(73) Assignee: ROBOT Visual Systems GmbH, Monheim (DE)

( * ) Notice: Subject to any disclaimer, the term of this patent is extended or adjusted under 35 U.S.C. 154(b) by 540 days.

(21) Appl. No.: 12/338,463

(22) Filed: Dec. 18, 2008

(65) Prior Publication Data

US 2009/0167566 A1 Jul. 2, 2009

(30) Foreign Application Priority Data

Dec. 27, 2007 (EP) ..... 07025103

(51) Int. Cl.
*G08G 1/01* (2006.01)

(52) U.S. Cl. ..... 340/933; 340/936; 340/937

(58) Field of Classification Search ..... 340/435, 340/436, 905, 933, 935, 936, 937; 348/143, 348/148, 149; 701/300, 301
See application file for complete search history.

(56) References Cited

U.S. PATENT DOCUMENTS

| | | | | |
|---|---|---|---|---|
| 6,466,260 | B1 | 10/2002 | Hatae et al. | |
| 2002/0145664 | A1 | 10/2002 | Jones | |
| 2003/0189499 | A1 | 10/2003 | Stricklin et al. | |
| 2005/0156757 | A1 * | 7/2005 | Garner | 340/907 |
| 2006/0047371 | A1 * | 3/2006 | Janssen | 701/1 |
| 2006/0269104 | A1 * | 11/2006 | Ciolli | 382/104 |

* cited by examiner

*Primary Examiner* — Van T. Trieu
(74) *Attorney, Agent, or Firm* — Duane Morris LLP

(57) ABSTRACT

According to the present invention, a first measured data packet $M_1$ of a first vehicle 1 at a first measuring time point $t_{M1}$ and a first image data packet $B_1$ are generated, and measured data packets $M_X$ of additional vehicles X are generated at additional measuring time points $t_{MX}$, to which measured data packets duplicates of the first image data packet $B_1$ are linked to the extent that the additional measuring time points $t_{MX}$ occur within a predetermined time interval $\alpha$ after the first measuring time point $t_{M1}$.

11 Claims, 1 Drawing Sheet

METHOD OF DETECTING AND DOCUMENTING TRAFFIC VIOLATIONS, SUCH AS RED LIGHT VIOLATIONS OR SPEEDING VIOLATIONS

FIELD OF THE INVENTION

The subject matter of the present invention relates to a method of detecting and documenting traffic violations, such as red light violations or speeding violations.

BACKGROUND OF THE INVENTION

From the prior art, numerous methods of detecting traffic violations are known, which methods provide that, upon detection of a certain event, a camera is triggered so as to capture image data of the violating vehicle.

Such events include, e.g., the detection of a vehicle that is exceeding the speed limit or of a vehicle that does not maintain the prescribed minimum distance relative to a reference point or of a vehicle that drives into a prohibited area which is controlled by a traffic light, or the detection of prescribed features of a vehicle, such as exceeding a minimum length.

Depending on the event, the camera can be triggered at least one more time, typically after a predetermined time has lapsed, in order to obtain at least two sets of image data of the violating vehicle.

As to the method according to the present invention, it is immaterial how the camera is triggered. For simplicity's sake, the term triggering will hereinafter be used to cover all possibilities of activating a camera as a result of the detection of a violating vehicle.

As far as the use is concerned, the methods of detecting traffic violations and systems suitable for this purpose can be divided into those in which the measuring range of a measuring system and the object field of a camera are limited to one vehicle lane only, and those in which the measuring range and the object field extend across a plurality of lanes.

Using a measuring system, which can include sensors located on or in the vehicle lane, radar measuring systems, laser measuring systems or video cameras with image processing systems, the vehicles passing through the measuring range or the measuring ranges are measured. Based on the results measured, the vehicle data of interest are determined.

As a rule, these data of interest are the speed of the vehicle, a detection signal and/or the distance from the measuring system. In measuring systems the measuring range of which extends across a plurality of vehicle lanes, the angle relative to the receiver axis of the measuring system might be included among the vehicle data of interest so as to be able to differentiate between vehicles that are in the measuring range or the measuring ranges at the same time and that drive in different vehicle lanes.

Based on the measured results obtained from a plurality of individual measurements that provide a set of measured data, it is possible to extrapolate additional specific vehicle data, such as the travel path of the vehicle through the measuring range or the length of the vehicle. The vehicle-specific data obtained from the measured results of a plurality of individual measurements in combination with identification data, such as date, time of day, location and device identity, are stored in the form of a measured data packet, which means that all sets of measured data being stored for one vehicle are combined to form a measured data packet.

The sets of image data captured by the camera are also stored, and all sets of image data that are linked to a specific vehicle form an image data packet.

According to the state of the art, the measured data packet and the image data packet are stored so as to be uniquely linked to each other. The unique linkage is possible since measuring a vehicle and capturing the image of the vehicle are linked actions that begin in known chronological correlation with respect to each other.

To record a speeding violation, a first image can be triggered, e.g., at the moment at which the measuring device verifies the excess speed, or the photo can be triggered when the vehicle is located at a predetermined distance from the camera, which distance is determined by the speed and a delay in time. In both cases, triggering the camera is initiated by a signal of the measuring device during the measuring procedure, which uniquely links the measured data packets and the image data packets to each other.

Similarly, there are methods in which the camera is triggered by a signal that is independent of the measuring system, e.g., by an induction loop. In this case, the measured data packet is uniquely linked to the associated image data packet by way of the fixed temporal correlation of the acquisition of the data. Thus, if acquisition of the measured data and the image data begins as the vehicle drives over the induction loop, the same time of day is linked to the measured data packet and to the image data packet, thus ensuring that this time of day uniquely links the measured data packet and the image data packet to each other.

According to the state of the art, linking the measured data packets to the image data packets, regardless of how this linkage is implemented, is always implemented by one-to-one and onto mapping, which is based on a known temporal correlation between the data packets. A fixed temporal correlation exists if a first measuring time point and a first image-taking time point temporally coincide or are at a defined temporal distance from each other.

Although the temporal correlation is not fixed, this correlation is known if a time delay is extrapolated from the measured speed and the known or measured distance in order to subsequently trigger the picture when the vehicle is at a predetermined distance from the camera.

One-to-one and onto mapping means that precisely one image data packet is linked to each measured data packet and precisely one measured data packet is linked to each image data packet.

It is immaterial at which moment a measured data packet and an image data packet are linked to each other, i.e., the packets can also be assembled immediately after the data have been acquired and can be jointly stored as a vehicle data packet.

This type of data processing has been found to have drawbacks, especially for solutions in which a plurality of vehicles can be measured at the same time or nearly at the same time.

After the camera has been triggered by a first vehicle, the camera, for a certain length of time, is not ready to be triggered by a second vehicle. How long this time is depends primarily on how many consecutive images are taken each time after a first image has been captured.

In the case of an alleged red light violation, typically after a first picture that captures the vehicle on the stop line, a second and possibly even a third picture follow that show the vehicle even with the traffic light or in the intersection. These pictures taken subsequently are captured either after a fixed time interval has elapsed or as a function of the speed of the violating vehicle at the moment when the violating vehicle is anticipated to arrive at a specific location.

Of vehicles measured within the resultant delay period and identified, by way of the measured results, as violating vehicles, no pictures are captured, which in turn means that there is also no image data packet. For these violating vehicles, it is not possible to generate a vehicle data packet, which means that these traffic violations cannot be documented and therefore no action can be taken against the violators.

A trivial solution to this problem would be to install one camera for each vehicle lane and for this camera to be activated every time a violation is detected that is linked to this particular vehicle lane. However, this entails higher acquisition, installation and maintenance cost for the operator.

SUMMARY

Thus, the problem to be solved by the present invention is to make available a method by means of which traffic violations that are metrologically detected nearly at the same time can be documented by means of one camera only.

This problem is solved by a method of documenting traffic violations, including capturing measured data of a first vehicle which passes through a predetermined measurement range on a roadway having a plurality of vehicle lanes and storing the measured data as a measured data packet jointly with a measuring time point. The method also includes taking a picture of the first vehicle with a camera at a picture-taking time point, which picture is stored as an image data packet, and wherein there is a known temporal correlation between the picture-taking time point and the measuring time point. This correlation makes it possible to link the image data packet uniquely to the measured data packet so as to be able to generate a first vehicle data packet. The method also includes capturing measured data for additional vehicles that pass through a predetermined measurement range and storing these measured data for the additional vehicles as measured data packets jointly with measuring time points, and checking to determine whether the measuring time points occur within a time interval after the measuring time point and that, if necessary, the image data packet is duplicated in order to link it to the relevant measured data packet so as to generate additional vehicle data packets.

BRIEF DESCRIPTION OF THE DRAWINGS

The method of the invention will be described in greater detail by way of an example in connection with the attached drawing, in which.

DESCRIPTION OF THE EMBODIMENTS OF THE INVENTION

Figure 1:
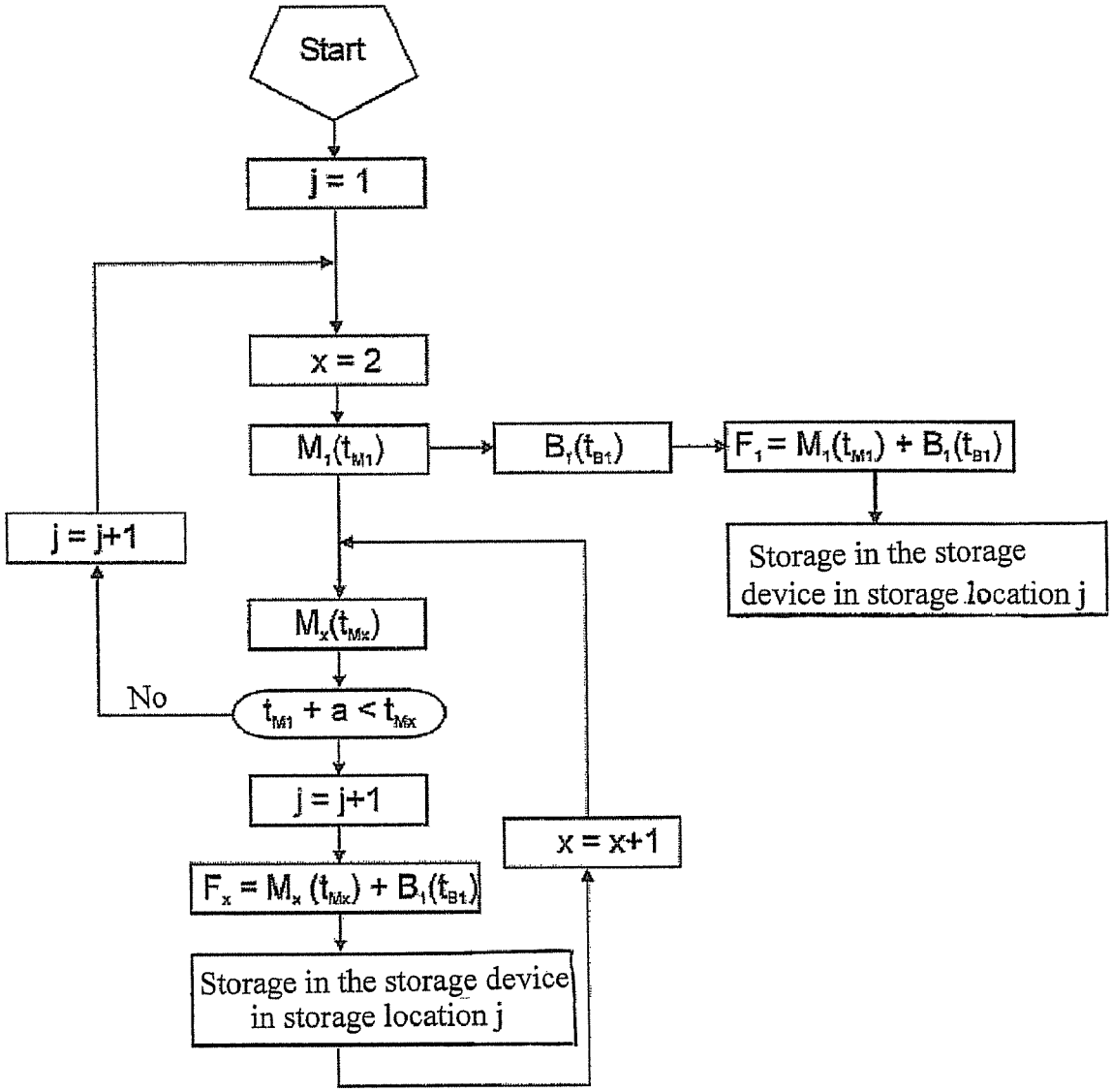
FIG. 1 is a flow chart illustrating the sequence of the procedure according to the present invention.

The invention is based on the notion of linking an image data packet $B_1$, which is linked to the measured data packet $M_1$ of a first violating vehicle 1, to the measured data packets $M_x$ of additional violating vehicles X that trigger the camera within a predetermined time interval $\alpha$ after the first violating vehicle 1.

A camera that covers an object field that extends across a plurality of vehicle lanes captures all vehicles located within the object field at the moment at which the camera is triggered. These are especially vehicles driving in other vehicle lanes, even with or just barely behind the violating vehicle that triggers the camera.

Accordingly, the time interval $\alpha$ is predetermined so that all vehicles detected within the time interval $\alpha$ are shown in one picture.

The length of this time interval depends primarily on the location and size of the object field and the speed of the additional violating vehicles.

Such a time interval will typically be shorter than 10 s and preferably shorter than 2 s.

All traffic violations that are detected within such a time interval $\alpha$ will be deemed to have occurred nearly simultaneously.

As in the methods of detecting traffic violations known from the prior art, a measuring system, e.g., a radar system, and a camera are disposed with respect to a vehicle lane in such a manner that the measurement range of the measuring system and the object field of the camera overlap and cover a plurality of vehicle lanes of the roadway.

Vehicles that pass through the measurement range being monitored by a measuring beam are measured a plurality of times along their passage through the measurement range. Based on the values measured per unit of time, data relevant to the vehicle, such as speed, distance and angle, are combined and stored as a measured data set that is linked to the moment at which the measurement was taken. All measured data sets that are associated with the same vehicle are assembled to form the measured data packet and are stored as such.

In addition thereto, the vehicle is also captured photographically. The camera is triggered, in the broadest sense of the term, by the vehicle itself, regardless of whether the signal for triggering the vehicle is generated by the measuring system or, e.g., by an induction loop. A first picture of the object field is taken in which the vehicle triggering the camera is seen. Subsequently, consecutive pictures can be taken. Per picture, an image data set is prepared; a plurality of image data sets form an image data packet and are stored linked to a picture-taking time point, generally to the moment at which the first picture was captured.

The measured data packets and the image-data packets are stored in such a manner that they can be identified by the first time a measurement was taken and the first time a picture was taken.

In contrast to the prior art in which the image data packets and the measured data packets are paired one-to-one and onto, the measured data packets are uniquely linked to an image data packet based on a predetermined temporal correlation range.

This means that precisely one image data packet is linked to each measured data packet, but a plurality of measured data packets can be linked to each image data packet.

The method will be described below based on the flow chart shown in FIG. 1.

As in the prior art, a measured data packet $M_1$, which, by way of a known temporal correlation, is identified by a first measuring time point $t_{M1}$, is generated by a first violating vehicle 1 and linked to an image data packet $B_1$ which is identified by a first picture-taking time point $t_{B1}$ and caused by this first violating vehicle 1, thus generating a vehicle data packet $F_1$.

Subsequently, a check is carried out to determine whether there are additional measured data packets MX (X>1), the additional measuring time points $t_{MX}$ of which are within the time interval a after the first measuring time point $t_{M1}$. If this is the case, the image data packet $B_1$ is duplicated, and the duplicate of the image data packet $B_1$ is linked to the respective next w measured data packet $M_X$ in order to generate additional vehicle data packets $F_X$.

If this is not the case, a check is carried out to determine whether the camera is ready and, if so, the procedure starts from the beginning. The generated vehicle data packets $F_1$ and possibly $F_X$ (X>1) are stored in the storage device in storage locations j.

If a plurality of pictures of the violating vehicle are taken, the interval $\alpha$ selected must at most be of such a length that the second violating vehicle also is found in all image data sets of the associated image data packet.

Preferably, the time interval $\alpha$ is predetermined as a function of the speed of the violating vehicles. The smaller the difference between the speed of the first and the speed of the second violating vehicle, the greater the time interval $\alpha$ that can be selected. The greater the difference between the speeds of the vehicles, the more probable it is that the second vehicle will not be captured in all pictures.

To simplify the procedure, the time interval $\alpha$ can also be a fixed quantity, especially if only one picture is triggered or if the violating vehicles are expected to drive at nearly identical speeds.

If only one picture is triggered, the time interval selected can be of such a length that the only certainty is that the vehicle was already in the object field of the camera when the picture was triggered by a preceding violating vehicle.

In practice, a time interval $\alpha$ shorter than 10 s has been found to be a suitable time lag. The time interval $\alpha$ is preferably equivalent to the delay period of the camera, i.e., the length of time that elapses between the moment at which a first picture is triggered by a violating vehicle and the moment at which the camera is again ready to be triggered by the next violating vehicle.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

The invention claimed is:

1. A method of documenting traffic violations, comprising, capturing measured data of a first vehicle having a speed, which passes through a predetermined measurement range on a roadway having a plurality of vehicle lanes, storing said measured data as a measured data packet jointly with a measuring time point, taking a picture of said first vehicle with a camera at a picture-taking time point, which picture is stored as an image data packet, wherein there is a known temporal correlation between the picture-taking time point and the measuring time point, which correlation makes it possible to link the image data packet uniquely to the measured data packet in order to be able to generate a first vehicle data packet, and capturing measured data for additional vehicles having speeds that pass through a predetermined measurement range and storing said measured data for said additional vehicles as measured data packets jointly with measuring time points, and checking to determine whether said measuring time points occur within a time interval after said measuring time point of the first vehicle and that, if necessary, the image data packet is duplicated in order to link it to the measured data packets of said additional vehicles in order to generate additional vehicle data packets.

2. The method as in claim 1, wherein said measurement range is specified for each vehicle lane.

3. The method as in claim 2, wherein said measurement ranges are determined by sensors located in each said vehicle lane.

4. The method as in claim 3, wherein said captured measured data are the speeds of said vehicles.

5. The method as in claim 1, wherein only one measurement range is determined by a measuring beam that extends across a plurality of vehicle lanes.

6. The method as in claim 5, wherein said measurement beam is a radar beam.

7. The method as in claim 6, wherein said measured data are the speeds of said vehicles, their distance from a measurement system and their angles relative to an axis of the measuring system.

8. The method as in claim 1, wherein said time interval is shorter than 10 seconds.

9. The method as in claim 8, wherein said time interval is predetermined as a function of difference of the speeds between said vehicles.

10. The method as in claim 8, wherein said time interval is predetermined and constitutes a fixed quantity.

11. The method as in claim 1, wherein said time interval is shorter than 2 seconds.

* * * * *